US005123759A

United States Patent [19]

Horii et al.

[11] Patent Number: 5,123,759

[45] Date of Patent: Jun. 23, 1992

[54] DOT MATRIX PRINT HEAD

[75] Inventors: Masami Horii; Takashi Kondoh; Takeji Tuchiya, all of Shizuoka, Japan

[73] Assignee: Tokyo Electric Co., Ltd., Tokyo, Japan

[21] Appl. No.: 766,213

[22] Filed: Sep. 27, 1991

[30] Foreign Application Priority Data

Sep. 28, 1990 [JP] Japan ..... 2-261585

[51] Int. Cl.[5] ..... B41J 2/235; B41J 2/255

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,433,927 | 2/1984 | Cavallari | 400/124 |
| 4,723,854 | 2/1988 | Sakaida et al. | 400/124 |
| 4,884,905 | 12/1989 | Smith | 400/124 |
| 5,009,528 | 4/1991 | Horii et al. | 400/124 |
| 5,033,885 | 7/1991 | Gugel et al. | 400/124 |

FOREIGN PATENT DOCUMENTS

| | | | |
|---|---|---|---|
| 62-87852 | 6/1987 | Japan . | |
| 0124959 | 6/1987 | Japan | 400/124 |

*Primary Examiner*—Edgar S. Burr
*Assistant Examiner*—Lynn D. Hendrickson
*Attorney, Agent, or Firm*—Oblon, Spivak, McClelland, Maier & Neustadt

[57] ABSTRACT

The present invention provides a compact dot matrix print head comprising a housing internally provided with print wires, electromagnets for driving the print wires, a printed wiring board having a diameter smaller than the outside diameter of the rear end of the housing, fixedly joined to the rear end of the housing and provided with wiring patterns connected to the coils of the electromagnets, connectors connected to the outer surface of the printed wiring board so that the conductors thereof are connected electrically to the wiring patterns, and flexible cables each having one end connected to the connector and the other end connected to a driving unit for driving the electromagnets.

5 Claims, 5 Drawing Sheets

DOT MATRIX PRINT HEAD

FIELD OF THE INVENTION AND RELATED ART STATEMENT

1. Field of the Invention

The present invention relates to a dot matrix print head.

2. Prior Art

A dot matrix printer is provided with a dot matrix print head mounted on a carriage which reciprocates along a platen, and a driving unit for driving the dot matrix print head. The driving unit must be connected to the electromagnets of the dot matrix print head by a flexible cable to give signals to the dot matrix print head. As shown in FIGS. 8 to 10, a first connecting method fixes a printed wiring board 51 having a connector 52 to the backside of a housing 50 internally provided with a plurality of electro-magnets for driving print wires so that the connector 52 projects from the lower end of the housing 50 to connect the printed wiring board 51 to the coils of the electromagnets, connects a printed wiring board 54 to one end of a flexible cable 53 having the other end connected to a driving unit, fixes a connector 55 to the printed wiring board 54, and couples the connectors 52 and 55.

As shown in FIGS. 11 and 12, a second connecting method fixes the printed wiring board 51 to the backside of a housing 50, forms a connector 56 at the lower end of the printed wiring board 51 projecting beyond the lower end of the printed wiring board 51, and connects the flexible cable 53 to the connector 56.

As shown in FIG. 13, a third connecting method disclosed in Japanese Utility Model Laid-open (Kokai) No. Sho 62-87852 employs a flexible cable 60 provided at one end thereof with a printed wiring board 58 connected to the coils of the electromagnets of a dot matrix print head 57, and the other end provided with a connector 59 to be connected to a driving unit.

The first connecting method shown in FIGS. 8 to 10 increases the overall size of the dot matrix print head because the connector 52 of the printed wiring board 51 projects beyond the lower end of the housing 50. The downward projection of the connector 52 of the printed wiring board 51 increases the height of the dot matrix print head, increasing the overall height of the printer. Similarly, if the connector 52 of the printed wiring board 51 projects laterally, namely, in the direction of movement of the carriage, the width of the printer will be increased. Since conductors connected to the electromagnets must be gathered in a close arrangement on one side of the printed wiring board 51, it is difficult to form the conductors in such a close arrangement and such a close arrangement of the conductors may possibly cause faulty connection. The same problems are true of the second connecting method shown in FIGS. 11 and 12. Since the flexible cable 60 employed in the third connecting method shown in FIG. 13 is free to flex near the periphery of the dot matrix print head 57, the flexible cable 60 requires a comparatively small space around the dot matrix print head 57. However, a portion of the printed wiring board 58 close to the electromagnets of the dot matrix print head 57 is liable to be effected by heat. Accordingly, the flexible cable 60 must have excellent heat resistance and such a flexible cable is expensive. Since the coils are soldered directly to the conductors of the flexible cable 60, the flexible cable 60 must be formed of a material having high heat resistance. Furthermore, since both the conductors and terminals to be connected to the conductors of the flexible cable 60 are formed on a flexible printed wiring board, the flexible cable 60 must be formed in a special shape, which increases the cost.

OBJECT AND SUMMARY OF THE INVENTION

A first object of the present invention is to provide a compact dot matrix print head.

A second object of the present invention is to provide a dot matrix print head capable of employing a rigid printed wiring board.

A third object of the present invention is to provide a dot matrix print head capable of employing an inexpensive flexible cable having comparatively low heat resistance.

A fourth object of the present invention is to provide a dot matrix print head to which a flexible cable can be connected easily.

A fifth object of the present invention is to provide a dot matrix print head employing a printed wiring board provided with a connector protruding in a small height from the outer surface of the printed wiring board.

In one aspect of the present invention, a dot matrix print head comprises: a housing internally provided with a plurality of electromagnets for driving print wires; a printed wiring board having a size equal to or smaller than that of the rear end of the housing, attached to the rear end of the housing and provided with wiring patterns of conductors connected to the electromagnets; connectors joined to the printed wiring board and connected to the conductors of the wiring patterns; and flexible cables each having one end having a contact portion detachably connected to the connector and the other end connected to a driving unit for driving the electromagnets.

The connector is provided with conductors to be detachably connected to the contact portion of the flexible cable, inclined to the outer surface of the printed wiring board.

Conductive through holes are formed in the printed wiring board to form connecting portion on the printed wiring board.

Since the size of the printed wiring board provided with the wiring patterns is equal to or smaller than that of the housing, and the connectors to which the flexible cables are connected are connected to the printed wiring board in the outer surface of the printed wiring board, the dot matrix print head can be formed in a comparatively small size. Since the printed wiring board connected to the rear end of the housing may be formed of a rigid material, and the flexible cables are remote from the electromagnets contained in the housing and is scarcely effected by heat, the flexible cable may be an inexpensive flexible cable having a comparatively low heat resistance and available on the market, which contributes to the reduction of the cost of the dot matrix print head.

The connector having the terminals inclined to the outer surface of the printed wiring board makes the interior of the connector easily visible, and hence facilitates connecting the flexible cable to the connector, as compared with a connector which requires the insertion of the connecting portion of a flexible cable in the connector in parallel to the backside of the printed wiring board. Therefore, the height of the connector from the backside of the printed wiring board can be further reduced.

Still further, the through hole formed in the printed wiring board facilitates operation for forming wiring patterns on both the sides of the printed wiring board and work for connecting the wiring patterns.

DETAILED DESCRIPTION OF THE PREFERRED EMBODIMENTS

Figure 1:
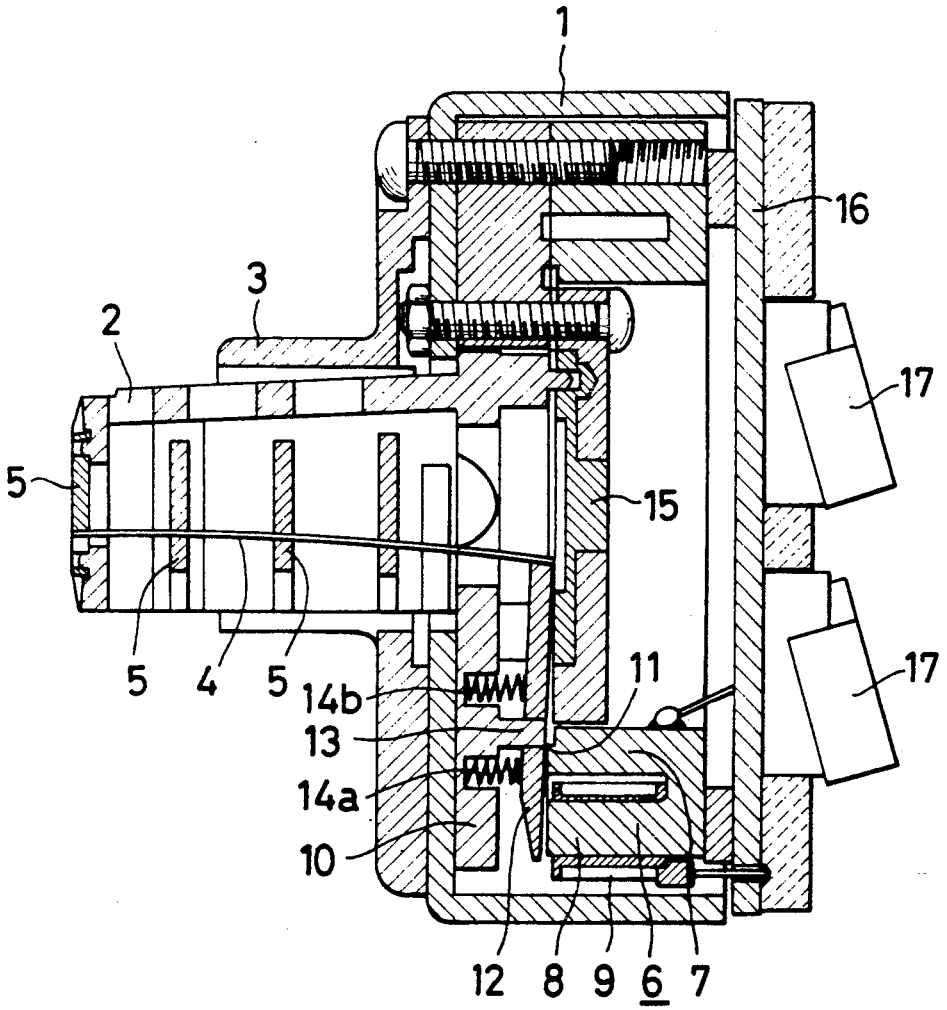
FIG. 1 is a longitudinal side view of a dot matrix print head in a preferred embodiment according to the present invention.

A dot matrix print head in a preferred embodiment according to the present invention will be described with reference to FIGS. 1 to 7. A cup-shaped housing 1 has an open rear end. A guide member 3 having a central projection 2 is fixed to the housing 1. The projection 2 is provided with a plurality of wire guides 5 slidably supporting a plurality of print wires 4. A plurality of electromagnets 6 are provided within the housing 1. Each electromagnet 6 comprises an annular yoke 7 integrally having a core 8, a coil 9 wound around the core 8, and an armature 12 supported for swing motion on a supporting point 11 thereof on an armature guide 10. The armature guide 10 has a plurality of columns 13 for holding the armatures 12. Holding springs 14*a* for holding the armatures 12 in place on the yokes 7, and return springs 14*b* for returning the armatures 12 to their standby positions are mounted on the armature guide 10. A stopper 15 limits the return swing of the armatures 12 to their standby positions. The print wire 4 is brazed to the inner end of the armature 12. A hard printed wiring board 16 is fixed to the open rear end of the housing 1. The diameter of the printed wiring board 16 is slightly smaller than the outside diameter of the housing 1. A plurality of connectors 17 are provided on the outer surface of the printed wiring board 16.

Figure 2:
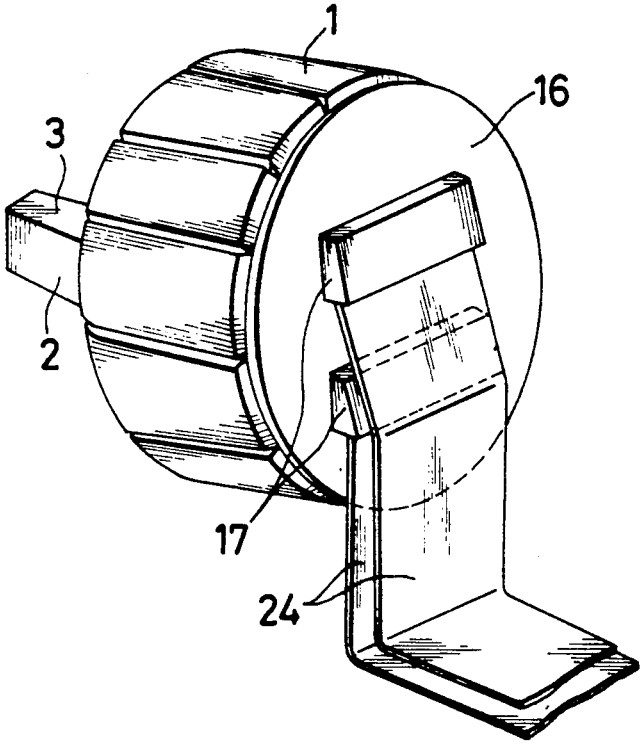
FIG. 2 is a perspective view of the dot matrix print head of FIG. 1.
Figure 3:
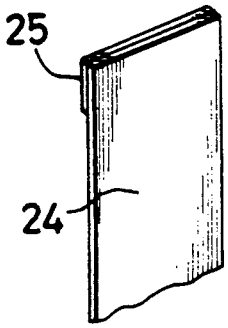
FIG. 3 is a perspective view of a portion of a flexible cable.
Figure 4:
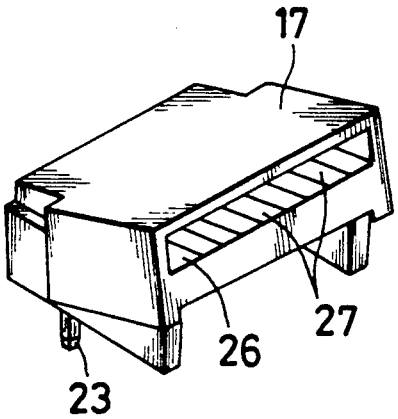
FIG. 4 is a perspective view of a connector.
Figure 5:
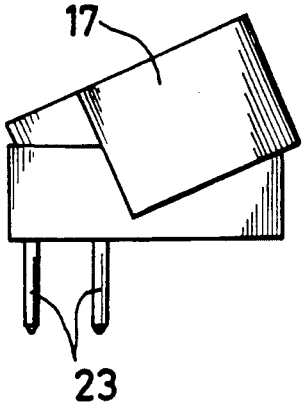
FIG. 5 is a side view of the connector of FIG. 4.
Figure 6:
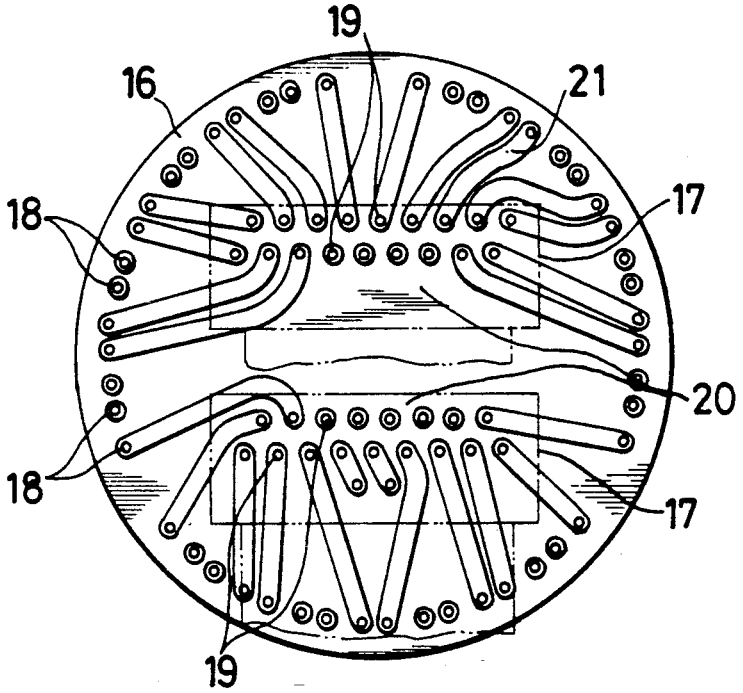
FIG. 6 is a plan view of the outer surface of a printed wiring board.
Figure 7:
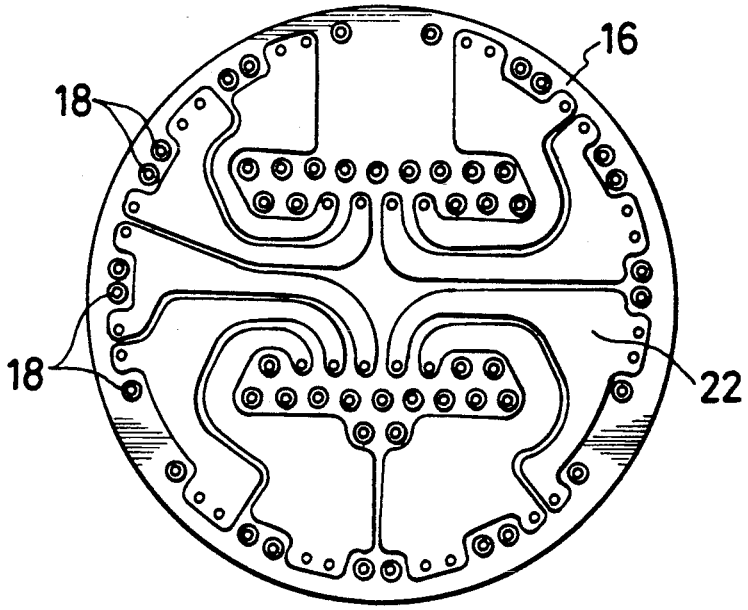
FIG. 7 is a plan view of the inner surface of the printed wiring board of FIG. 6.
Figure 8:
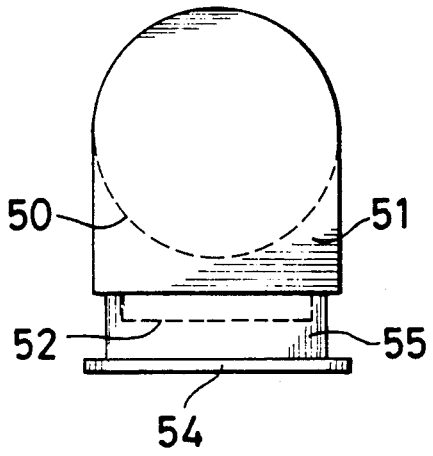
FIG. 8 (PRIOR ART)
FIG. 8 is a rear view of a first conventional dot matrix print head.
Figure 9:
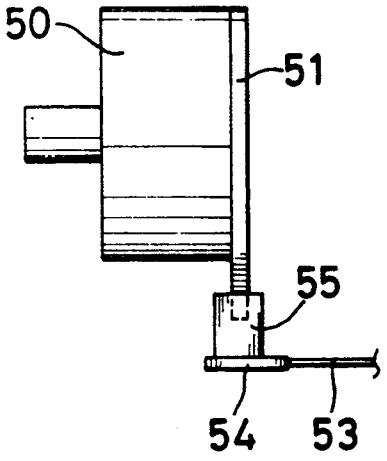
FIG. 9 (PRIOR ART)
FIG. 9 is a side view of the dot matrix print head of FIG. 8.
Figure 10:
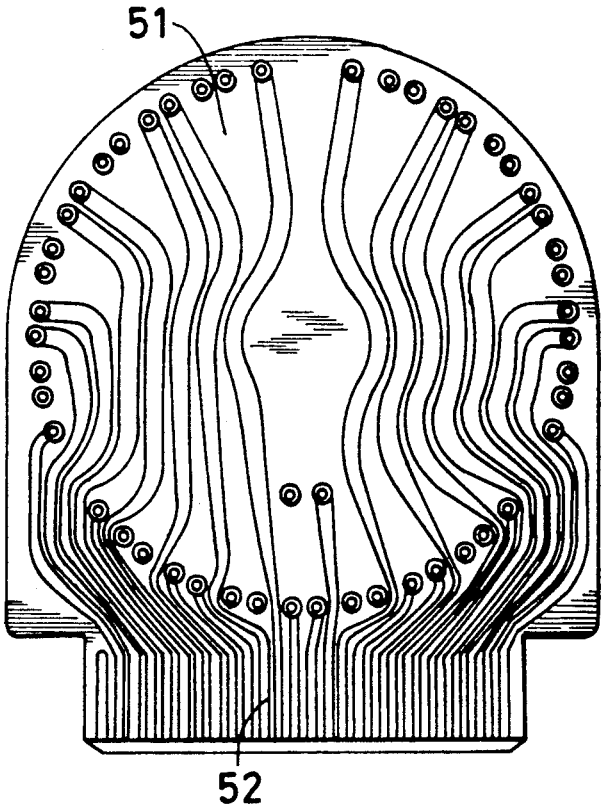
FIG. 10 (PRIOR ART)
FIG. 10 is a plan view of a printed wiring board.
Figure 11:
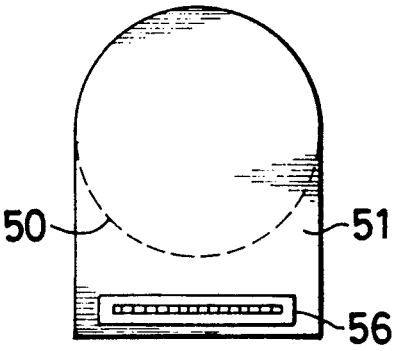
FIG.11 (PRIOR ART)
FIG. 11 is a rear view of a second conventional dot matrix print head.
Figure 12:
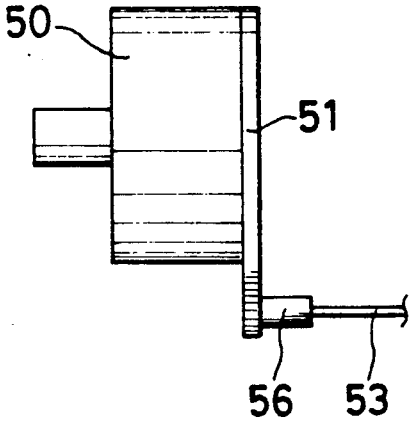
FIG.12 (PRIOR ART)
FIG. 12 is a side view of the dot matrix print head of FIG. 11.
Figure 13:
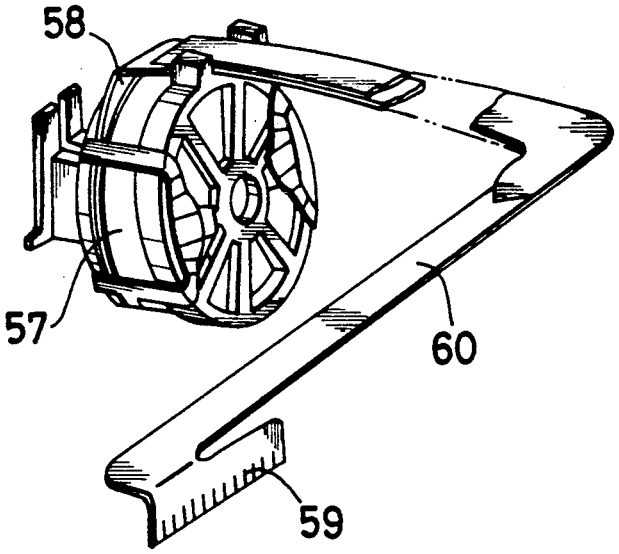
FIG.13 (PRIOR ART)
FIG. 13 is a perspective view of a third conventional dot matrix print head.

As shown in FIGS. 6 and 7, the printed wiring board 16 is provided with a plurality of conductive through holes 18 for the coils 9 in its periphery, and two connecting portions 20 formed in its inner area and provided each with a plurality of conductive through holes 19. The connectors 17 are connected respectively to the connecting portions 20. Wiring patterns 21 and 22 for connecting the conductive through holes 18 to the conductive through holes 19 are formed respectively in the outer and inner surfaces of the printed wiring board 16. As shown in FIGS. 4 and 5, each connector 17 is provided with a plurality of connecting pins 23 to be inserted in the conductive through holes 19. As shown in FIG. 3, a flexible cable 24 is provided at its free end with a contact portion 25, which is inserted in an opening 26 (FIG. 4) formed in the connector 17. As shown in FIG. 4, the connector 17 is provided internally with a plurality of conductors 27. The contact portion 25 of the flexible cable 24 is connected through the conductors 27 and the connecting pins 23 to the conductive through holes 19. The opening 26 and the conductors 27 are inclined slightly to the outer surface of the printed wiring board 16 when the connector 17 is connected to the printed wiring board 16. The other end of the flexible cable 24 is connected to a driving unit, not shown, for driving the electromagnets. The contact portion 25 of the flexible cable 24 is connected to the connector 17 as shown in FIG. 2 to connect the coils 9 to the driving unit.

In printing operation, the coils 9 are energized selectively to attract the armatures 12 selectively to the corresponding cores 8 so that the print wires 4 apply impact through an ink ribbon on a sheet wound around a platen for printing.

Thus, the dot matrix print head can be formed in a comparatively small size, because the printed wiring board 16 provided with the wiring patterns 21 and 22 has a diameter smaller than the outside diameter of the housing 1, and the connectors 17 to which the flexible cables 24 are connected are connected to the printed wiring board 16 in the inner areas of the printed wiring board 16. The flexible cable 24 may be an inexpensive flexible cable available on the market, having comparatively low heat resistance and hence the cost of the dot matrix print head can be reduced, because the printed wiring board 16 fixed to the rear end of the housing 1 may be a rigid printed wiring board and the flexible cable 24 is separated from the electromagnets 6 contained in the housing 1 and is effected scarcely by heat.

The conductors 27 of the connectors 17 inclined to the outer surface of the printed wiring board 16 makes the interior of the connectors 17 easily visible from behind the printed wiring board 16, facilitates connecting the contact portions 25 of the flexible cables 24 to the conductors 27 of the connectors 17, as compared with the conductors of a connector 17 requiring the insertion of the contact portion 25 of a flexible cable 24 in the connector 17 in parallel to the outer surface of the printed wiring board 16, and enables the height of the connectors 17 from the outer surface of the printed wiring board 1 to be further reduced.

What is claimed is:

1. A dot matrix print head comprising:

a housing with a rear end having an outside diameter and internally provided with a plurality of electromagnets having coils combined respectively with print wires;

a printed wiring board having an inner surface and an outer surface and a diameter smaller than the outside diameter of the rear end of said housing and fixedly joined on the end of said housing;

wiring patterns formed on said printed wiring board and connected to the coils of the electromagnets;

connectors with conductors on one side connected to the outer surface of said printed wiring board at a location substantially central thereof so that the conductors thereof are connected electrically to said wiring patterns; and flexible cables each having one end having a contact portion detachably connected to the conductors of said connector and having another end connected to a driving unit for driving the electromagnets.

2. A dot matrix print head according to claim 1, wherein the conductors of said connectors to which the contact portions of said flexible cables are connected are inclined to the flat surface of said printed wiring board, and comprising means to detachably connect said contact portions to said conductors.

3. A dot matrix print head comprising:

a housing with a rear end having an outside diameter and internally provided with a plurality of electromagnets having coils combined respectively with print wires;

a printed wiring board having an inner surface and an outer surface and a diameter smaller than the outside diameter of the rear end of said housing and fixedly joined on the rear end of said housing;

connecting means having a plurality of conductive through holes formed in said printed wiring board;

wiring patterns formed respectively on the inner and outer surfaces of said printed wiring board so as to be connected to the coils of the electromagnets and the conductive through holes of said connecting means, respectively;

connectors with conductors on one side connected to the outer surface of said printed wiring board at a location substantially central thereof so that the conductors thereof are connected to the conductive through holes of said connecting means; and flexible cables each having one end having a contact portion detachably connected to the conductors of said connector and having another end connected to a driving unit for driving the electromagnets.

4. A dot matrix print head according to claim 3, wherein said connecting means comprises two connecting portions, and two connectors are connected respectively to said connecting means.

5. A dot matrix print head according to claim 3, wherein said connectors are provided with connecting pins to be inserted in the conductive through holes of said connecting means.

* * * * *